US008001880B2

(12) United States Patent
White et al.

(10) Patent No.: US 8,001,880 B2
(45) Date of Patent: Aug. 23, 2011

(54) BARRIER

(75) Inventors: William Collins White, Cicero, NY (US); John Kleniatis, Jamesville, NY (US)

(73) Assignee: Defenshield, Inc., East Syracuse, NY (US)

( * ) Notice: Subject to any disclaimer, the term of this patent is extended or adjusted under 35 U.S.C. 154(b) by 472 days.

(21) Appl. No.: 12/115,283

(22) Filed: May 5, 2008

(65) Prior Publication Data

US 2008/0271652 A1 Nov. 6, 2008

Related U.S. Application Data

(60) Provisional application No. 60/916,099, filed on May 4, 2007.

(51) Int. Cl.
*F41H 5/24* (2006.01)

(52) U.S. Cl. ..... 89/36.04; 89/920; 404/6

(58) Field of Classification Search ..... 89/36.04, 89/920, 36.01; 404/6
See application file for complete search history.

(56) References Cited

U.S. PATENT DOCUMENTS

| | | | |
|---|---|---|---|
| 772,055 | A | 10/1904 | Post |
| 1,253,964 | A | 1/1918 | Hack |
| 1,261,518 | A | 4/1918 | Hahre |
| 1,274,721 | A | 8/1918 | Krzan |
| 1,281,400 | A | 10/1918 | Larnell |
| 1,465,042 | A | 8/1923 | Hruska |
| 1,875,488 | A | 6/1931 | Peters |
| 2,370,596 | A | 2/1945 | Wallace |
| 2,613,243 | A | 10/1952 | Frear |
| 2,845,153 | A | 7/1958 | West |
| 2,985,174 | A | 5/1961 | Guth |
| 3,039,161 | A | 6/1962 | Gagnon |
| 3,590,685 | A | 7/1971 | Lane |
| 3,942,598 | A | 3/1976 | Council |
| 3,994,243 | A | 11/1976 | Anders |
| 4,030,219 | A | 6/1977 | Donovan |
| 4,061,093 | A | 12/1977 | Carstens, Jr. et al. |
| 4,214,411 | A | 7/1980 | Pickett |

(Continued)

FOREIGN PATENT DOCUMENTS

DE 2412568 9/1975

(Continued)

OTHER PUBLICATIONS

Mifram Security—Body Guard; www.miframsecurity.com; Aug. 2007.

(Continued)

*Primary Examiner* — J. Woodrow Eldred
(74) *Attorney, Agent, or Firm* — Woodcock Washburn LLP

(57) ABSTRACT

A barrier that includes attack resistant pane(s) (see DEFINITIONS section). In this way, a person behind the barrier can be protected when they are outside. More specifically, the person behind the barrier is protected, at least to some extent, from both: (i) vehicular attacks; and (ii) blast (for example, bombs) and/or ballistic (for example, bullet) attacks. Also, the protected person can see what is happening across the barrier because of the attack-resistant pane(s). Also, if the barrier is unanchored then it can be moved from place to place, for example, by heavy equipment, so that the same barrier can be re-deployed at different outdoor locations (or indoor locations) on an as-needed basis. Preferably, the barrier also includes framing pieces that secure the attack-resistant pane (s) to the body of the barrier, with the framing pieces being covered on one side by an attack-resistant material (preferably, hardened steel).

23 Claims, 3 Drawing Sheets

U.S. PATENT DOCUMENTS

| | | | | |
|---|---|---|---|---|
| 4,245,546 | A | | 1/1981 | Chiares |
| 4,351,558 | A | | 9/1982 | Mueller |
| 4,416,485 | A | | 11/1983 | Long |
| 4,674,394 | A | | 6/1987 | Martino |
| 4,781,101 | A | | 11/1988 | Zevuluni et al. |
| 4,901,964 | A | | 2/1990 | McConnell |
| 4,949,490 | A | | 8/1990 | Miller |
| 4,953,820 | A | | 9/1990 | Yoder |
| 5,244,172 | A | | 9/1993 | Allega |
| 5,293,807 | A | | 3/1994 | Haidu |
| 5,368,904 | A | | 11/1994 | Stephinson |
| 5,419,479 | A | | 5/1995 | Evels et al. |
| 5,438,908 | A | | 8/1995 | Madden, Jr. |
| 5,560,149 | A | | 10/1996 | Lafevre |
| 5,703,316 | A | | 12/1997 | Madden, Jr. |
| 5,857,730 | A | | 1/1999 | Korpi et al. |
| 5,878,519 | A | | 3/1999 | Huyck et al. |
| 6,000,347 | A | | 12/1999 | Madden, Jr. |
| 6,082,240 | A | * | 7/2000 | Middione et al. ..... 89/36.08 |
| 6,116,326 | A | | 9/2000 | Domina et al. |
| 6,333,085 | B1 | | 12/2001 | Emek |
| 6,622,607 | B1 | | 9/2003 | Miller |
| 6,907,811 | B2 | | 6/2005 | White |
| 6,962,461 | B2 | | 11/2005 | Choi et al. |
| 7,069,680 | B1 | | 7/2006 | Crawford |
| 7,104,720 | B2 | | 9/2006 | Humphries et al. |
| 7,128,308 | B2 | | 10/2006 | Marsh et al. |
| 2003/0167911 | A1 | | 9/2003 | White |
| 2004/0255769 | A1 | | 12/2004 | Drackett |
| 2005/0265780 | A1 | | 12/2005 | Humphries et al. |
| 2006/0000671 | A1 | | 1/2006 | Nolley |

FOREIGN PATENT DOCUMENTS

| | | | |
|---|---|---|---|
| EP | 1 172 484 | A | 1/2002 |
| EP | 1172484 | A | 1/2002 |
| FR | 2607238 | | 5/1988 |
| WO | WO94/29665 | | 12/1994 |
| WO | WO 2007/009134 | A | 1/2007 |
| WO | WO2007/009134 | A | 1/2007 |

OTHER PUBLICATIONS

Mifram Security—Bodyguard-Pro; http://www.tactical-life.com/online/products/mifram-securitys/; Nov. 2008.

International Search Report/Written Opinion for PCT/US2008/062693 filed May 5, 2008, mailed Jul. 1, 2009.

* cited by examiner

BARRIER

RELATED APPLICATION

The present application claims priority to U.S. provisional patent application No. 60/916,099, filed on May 4, 2007; all of the foregoing patent-related document(s) are hereby incorporated by reference herein in their respective entirety(ies).

BACKGROUND OF THE INVENTION

1. Field of the Invention

The present invention relates to attack-resistant panes (see DEFINITIONS section) and to barriers (see DEFINITIONS section) and unanchored barriers (see DEFINITIONS section).

2. Description of the Related Art

Attack-resistant panes are conventional. An attack resistant pane may be ballistic resistant, blast resistant, or both. The degree of ballistic resistance is sometimes rated under one of the following standards: (i) "Ballistic Resistant Protective Materials NIJ Standard 0108.01" by the National Institute of Justice of the U.S. Department of Justice (published at http://www.eeel.nist.gov/oles/Publications/NIJ-0108.01.pdf as of May 3, 2008 and herein incorporated by reference); and (ii) "Bullet-resisting Equipment UL 752" by Underwriters' Laboratories (published at http://ulstandardinfonet.ul.com/scopes/scopes.asp?fn=0752.html as of May 3, 2008 and herein incorporated by reference). The degree of blast resistance is sometimes rated under the following standard: GSA Testing Standard (published at the following websites (i) http://www.govsupply.com/Products/GSATest.cfm; (ii) http://www.govsupply.com/Docs/TestReports/GSATesting-StandardMemorandum.pdf; and (iii) http://www.govsupply-.com/Docs/TestReports/GSATestingStandard.pdf as of May 3, 2008 and are herein incorporated by reference.) It is noted that these standards of ballistic resistance and blast resistance are applicable not just to attack resistant panes, but more broadly to any attack resistant panel, such as an opaque panel. Conventionally, attack resistant panes are made of acrylic or glass, often reinforced with polycarbonate. Conventionally, attack resistant panes are usually a couple inches thick, but may be thinner depending on material used, degree of blast resistance required, degree of ballistic resistance desired and application. Conventional applications of attack resistant panes include external windows of buildings, internal windows of buildings and military vehicle windows.

Barriers and unanchored barriers are conventional. For example, one well known type of barrier, commonly used to direct vehicular traffic flow, is called a Jersey barrier. One conventional anchored barrier is the security bollard.

U.S. Pat. No. 7,104,720 ("Humphries 1") discloses a traffic noise barrier including a longitudinal barrier portion and panels. The panels may be made of a transparent material, such as PARAGLASS SOUNDSTOP acrylic sheet available from CYRO Industries. The transparent panels of the barrier of Humphries 1 are not disclosed to be attack-resistant.

US published patent application 2004/0255769 ("Drackett") discloses a mobile personal gunfire shield. The Drackett shield is attack-resistant, but it is not a barrier.

US published patent application 2005/0265780 ("Humphries 2") discloses a crashworthy traffic noise barrier including a longitudinal barrier portion, upstanding posts, longitudinal beams and panels. The panels may be reinforced with plastic threads, walls or net, and are designed to remain attached to the barrier, even in the event of a crash. The panels may be made of a transparent material, such as a cast acrylic glass panel with embedded plastic threads. The transparent panels of the barrier of Humphries 2 are not disclosed to be attack-resistant.

Description Of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

The present invention is directed to barriers that include attack resistant pane(s). In this way, a person behind the barrier can be protected when they are outside. More specifically, the person behind the barrier is protected, at least to some extent, from both: (i) vehicular attacks; and (ii) blast (for example, bombs) and/or ballistic (for example, bullet) attacks. Also, the protected person can see what is happening across the barrier because of the attack-resistant pane(s). Also, if the barrier is unanchored then it can be moved from place to place, for example, by heavy equipment, so that the same barrier can be re-deployed at different locations on an as-needed basis. Preferably, the barrier also includes framing pieces that secure the attack-resistant pane(s) to the body of the barrier, with the framing pieces being covered on one side by an attack-resistant material (preferably, hardened steel).

Various embodiments of the present invention may exhibit one or more of the following objects, functional features and/or advantages:

(1) pre-existing non-attack-resistant barriers (for example, standard jersey barriers) can be retrofit to be used in preferred attack-resistant barriers according to the present invention;

(2) a ballistic/blast resistant barrier is provided that is able to be implemented quickly, such as in dangerous situations;

(3) a ballistic/blast resistant barrier is provided that affords complete ballistic/blast resistant coverage to the entire body of an individual or team without restricting vision;

(4) a ballistic/blast resistant barrier is provided that may be conveniently broken down (and set-up) for ease of transport and maintenance;

(5) armor panels that may be slid into or out of the bracket assembly facilitate convenient break-down and set-up of the unit, or repair or replacement of damaged armor sections;

(6) superior protection from ballistic impacts;

(7) superior protection from blast forces; and (8) superior protection from vehicle impacts.

According to one aspect of the present invention, an attack-resistant barrier includes a barrier member, a cap and an upper wall. The barrier member is shaped as a Jersey barrier and includes a relatively narrow cap engaging portion and a relatively wide lower portion. The cap includes: (i) a barrier engaging portion shaped and located to wrap around the cap engaging portion; and (ii) a trough. The upper wall defines an attack side major surface and a protected side major surface. The upper wall includes: (i) a lower edge region mechanically connected to the trough; (ii) at least one attack-resistant pane having multiple pane edges; (iii) multiple channel members shaped and located to wrap around at least some of the pane edges; and (iv) multiple armor strips shaped and located on at least the attack side major surface as a facing over at least a portion of the channel members.

According to another aspect of the present invention, an attack-resistant barrier includes: a barrier member, and an attack-resistant wall. The barrier is adapted to act as a barrier (see DEFINITIONS section). The attack-resistant wall is mechanically connected to the barrier. The attack-resistant wall includes: at least one attack-resistant pane, and an attack-resistant opaque portion located around at least a portion of the attack-resistant pane.

According to another aspect of the present invention, an attack-resistant barrier includes a barrier member, an attack-resistant wall, attack resistant pane(s), channel members and armor strips. The barrier member is adapted to act as a barrier. The attack-resistant wall is mechanically connected to the barrier. The attack-resistant wall defines an attack side major surface and a protected side major surface. The attack-resistant wall includes: (i) at least one attack-resistant pane having multiple pane edges; (ii) multiple channel members shaped and located to wrap around at least some of the pane edges; and (iii) multiple armor strips shaped and located on at least the attack side major surface as a facing over at least a portion of the channel members.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
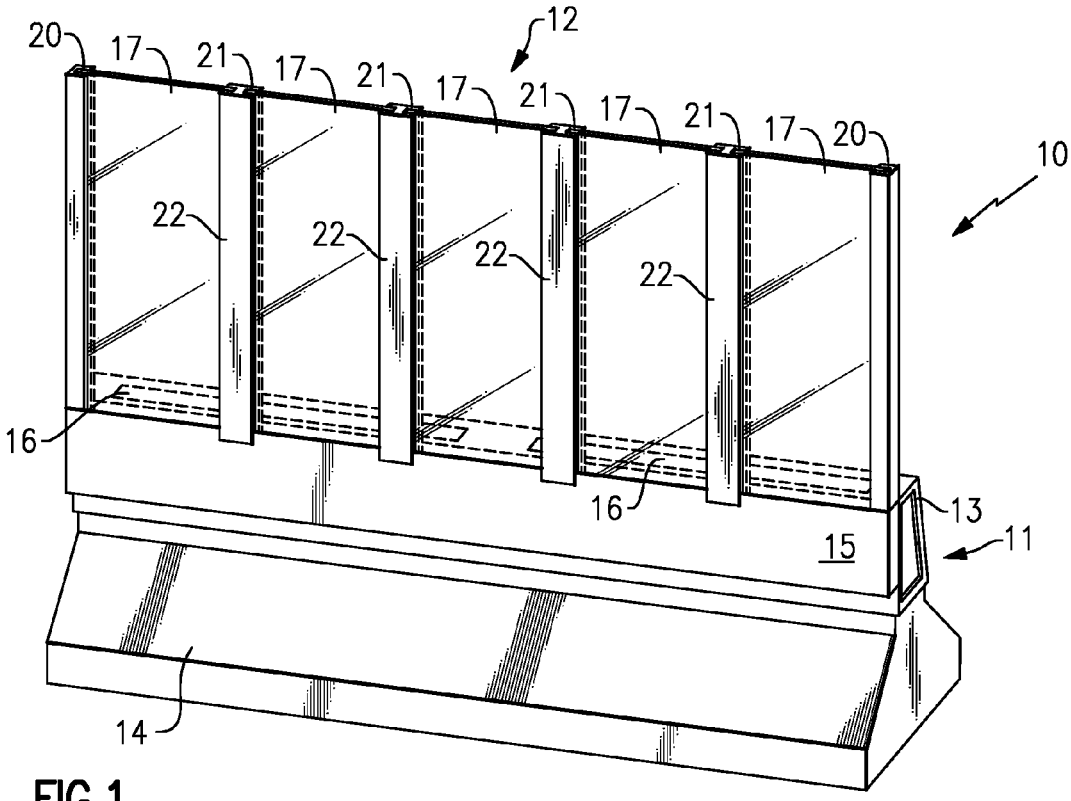
FIG. 1 is a front view that illustrates a barrier according to a first embodiment of the present invention.
Figure 2:
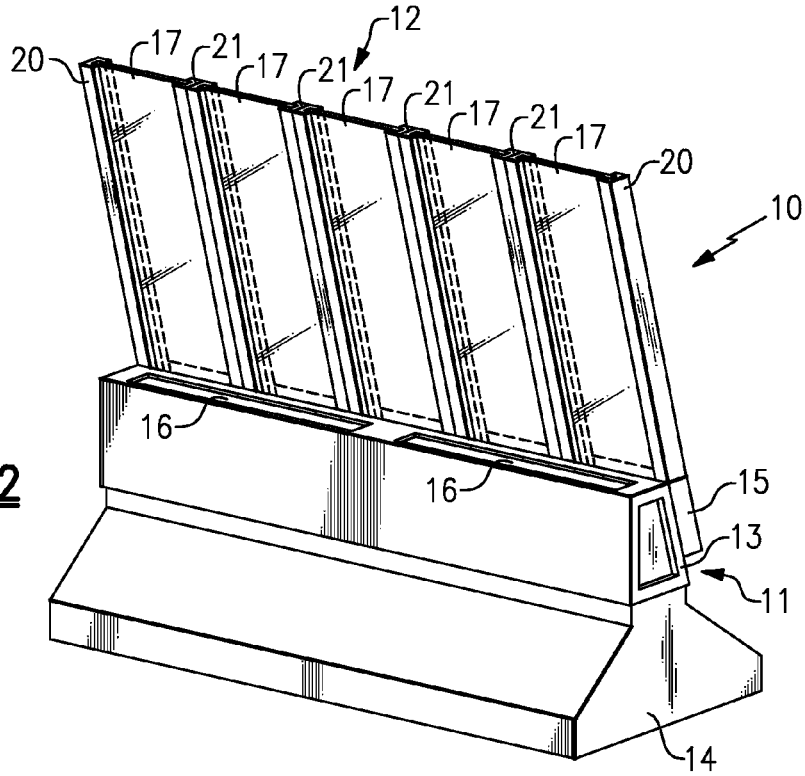
FIG. 2 is a rear view of the first embodiment barrier.
Figure 3:
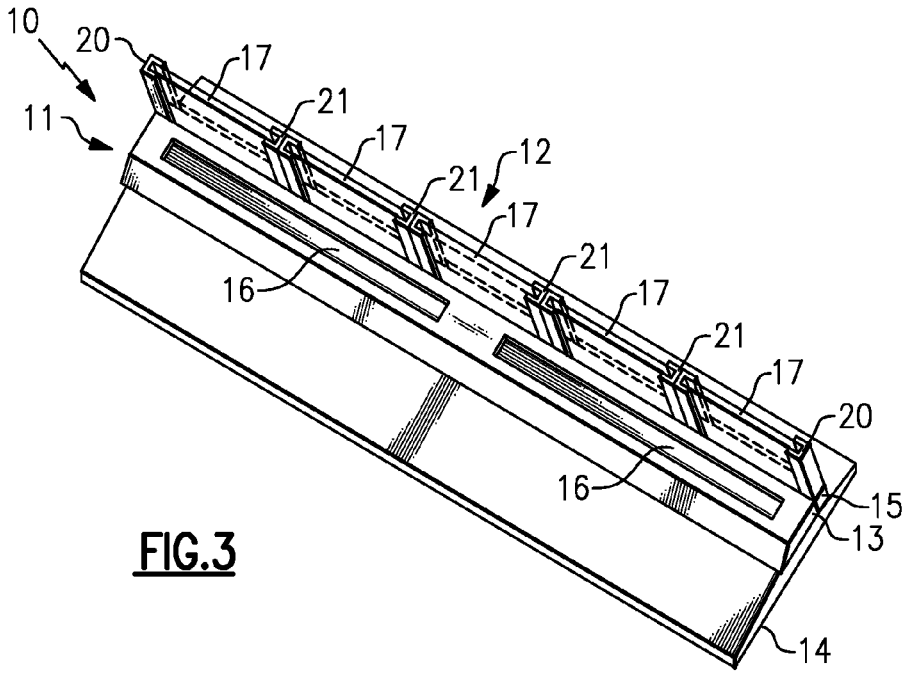
FIG. 3 is a top view of the first embodiment barrier.

FIGS. 1 to 3 show barrier 10, including: base unit 11; and upper wall 12. The base unit includes: cap 13; barrier portion 14; trough 15; and cut-outs 16. The upper wall includes attack-resistant panes 17; C-shaped channel 20; double C-channel members 21; and armor strips 22. The barrier portion of barrier 10 is shaped as a conventional Jersey barrier. The cap is engaged with the top of the barrier portion. The upper wall extends from the top of the cap in the upwards direction. Preferably, the barrier portion itself is pre-existing. For example, a pre-existing Jersey barrier could be retrofit with a cap and an upper wall. Even if the barrier portion itself is new, it may be made according to a pre-existing and/or mass produced barrier design. Barrier 10 may be conveniently broken down (and set-up) for ease of transport and maintenance.

Barrier portion 14 is preferably composed of a material, such as metal, plastic, ceramic or a composite material. Upper wall 12 is removably interconnected to the cap. A series of holes (not shown) around the perimeter of the cap allow for the cap to be permanently secured to the barrier portion by fasteners (not shown), such as lags, anchor bolts, "drop ins," or the like. The weight of the cap and its wrap-around engagement with the top of the barrier portion also help provide reliable securement of the cap and upper wall to the barrier portion. In some embodiments the weight and/or friction may be sufficient to secure the cap and eliminate the need for separate fasteners in this mechanical connection. This is important because the barrier is meant to protect against vehicular impacts, as well as ballistic and/or blast impacts.

The cut-outs in the top of the cap allow the barrier to be moved after the cap is installed to form the base unit. Preferably, the heavy concrete barrier portion has lifting grips (not shown) for lifting, where the lifting grips align with the cut-outs in the cap so that the grips protrude through the cut-outs and/or can be accessed through them. For example, these lifting grips may take the form of metal bars or wire loops anchored in the concrete of the barrier portion.

Trough 15 is formed as a separate piece that is attached to the rest of the cap and is considered to form a part of the finished cap. Preferably the trough is welded to the rest of the cap, but other types of mechanical connections may be possible. Alternatively, the trough could be formed as a single unitary piece with the rest of the cap. The trough is used to hold the upper wall. A series of holes (not shown) under the trough allow for the drainage of any moisture that otherwise may build up in the trough.

The attack-resistant panes 17 are composed of an attack-resistant material, such as plastic, acrylic, glass, polycarbonate-reinforced acrylic and/or polycarbonate reinforced glass. Alternative embodiments of the present invention may include only a single pane and/or have pane(s) of substantially different geometries than panes 17. Some trade names of suitable materials (which may be registered trademarks in some jurisdictions) are: Armortex; Frag-Stop; Hygard and Acryshield. Manufacturers of suitable attack-resistant pane materials include: North American Specialty Glass, Trumbauersville, Pa. USA and SABIC Innovative Plastics (formerly GE Plastics).

For handgun rounds we use a laminated polycarbonate/acrylic generally supplied by SABIC Innovative Plastics (formerly GE Plastics) The panes are secured to each other and to the cap by framing pieces 20, 21, 22 (sometimes referred to as a support network) to form the upper wall. It is this upper wall that makes the plain old barrier into an attack-resistant barrier, according to the present invention, because the attack-panes provide some degree of blast and/or ballistic protection, while still allowing protected people on one side of the barrier to see what is going on the other side of the barrier.

The support framework includes a C-shaped channel 20 located at each side end the upper wall 12, as shown in FIG. 1. Channel 20 is mechanically connected to the trough portion of the cap by an appropriate fastener. The bracket assembly further includes H-shaped double C-channel members 21, which are also attached to the trough by an appropriate fastener. These members 21 interconnect the ballistic/blast resistant transparent armor panels. Both the channels 20 and the members 21 are preferably made of a material that is rigid, but still relatively easy to form and shape, such as plain carbon steel. Channels 20 and members 21 do not need to be made from blast resistant and/or ballistic resistant material (sometimes referred to as armor), which is good because these pieces are difficult to manufacture from armor material.

Preferably, channels 20 and members 21 include a gasket within their channels interposed over at least a part of the surface area that interfaces with the panes. The gasket can help absorb mechanical shocks due to vehicle impacts, ballistic impacts and/or blast forces. Preferably, the gasket is made of rubber. Because of the C and H shapes of the pieces 20 and 21, the panes may be slid into or out of the support framework. This facilitates convenient break-down and set-up of the unit, or repair or replacement of damaged armor sections. A soap solution may be used to lubricate the panes when they are slid into and/or out of the support framework.

The surfaces of pieces 20, 21 facing at least one major surface of the upper wall (called the attack side) are covered with a facing in the form of armor strips 22. As their name implies, the armor strips are, because of their thickness and material choice, blast and/or ballistic resistant. Alternatively the armor strip facing can be used at both major surfaces of the upper wall. Armor strips 22 are made of hardened steel. Alternatively, the armor strips can be made of other materials, such as metal, plastic, ceramic or a composite material. The armor strips are used to cover gaps (or shield seams) between the panes 17. These armor strips are welded to channels on the front of the barrier and fit over the trough at the bottom of the panes.

Preferably the framing pieces, armor strips and trough are mechanically connected by welding at their mechanical interfaces, but other types of mechanical connections may be possible.

Between the thick concrete barrier, the attack resistant panes, and the armor strips, barrier 10 forms a wall that is blast and/or ballistic resistant comprehensively over its entire major surface area. This is important because it is undesirable to have a bullet and/or shrapnel get through any chink in the armor. This provides comprehensive protection to the people behind the barrier (sometimes referred to as the protected side). Because the upper wall makes barrier 10 significantly taller than a plain Jersey barrier, a person's entire body can be protected from forces that are vectoring substantially parallel to the ground. This provides good protection to the front of a person standing on the protected side.

The panes, armor strips and barrier portion (sometimes collectively called the armored components) should at least provide a degree of ballistic resistance or blast resistance so that the barrier a be considered to be attack resistant, unlike the barrier of Humphries 2, discussed above. More preferably, for ballistic resistant barriers, the armored components should be rated at least NIJ-I (see National Institute of Justice Standards discussed above), which is considered sufficient to stop a bullet from a .22 caliber gun. Even more preferably, for ballistic resistant barriers, the armored components should be rated at least UL Threat Level One (see Underwriters' Laboratories Standards discussed above), which is considered sufficient to stop a bullet from a 9 mm caliber gun.

Barrier 10 is not anchored to the ground, which means that it is "portable" (see Definitions section). It is the mass and shape of the Jersey barrier portion that really makes barrier 10 a barrier (see DEFINITIONS section), as opposed to a mere attack-resistant wall. Alternatively, some barriers according to the present invention could be anchored to the ground and/or pre-existing man-made structures, with the anchoring helping the barrier to act as a barrier.

Figure 4:
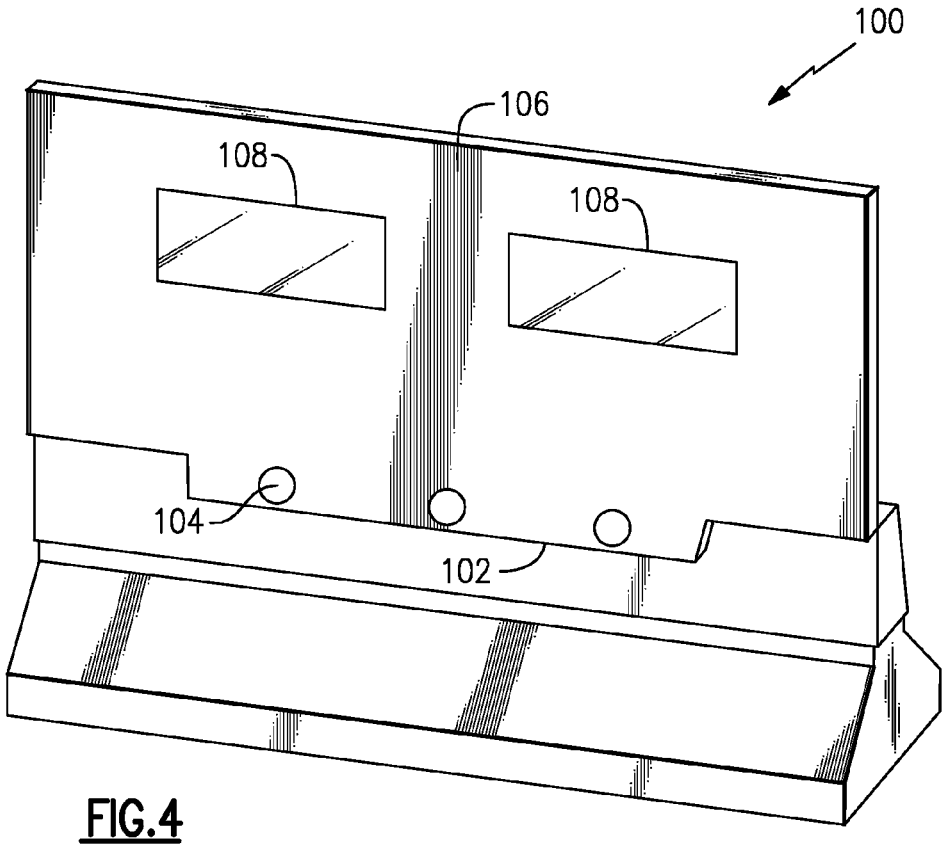
FIG. 4 is a front view of a barrier according to a second embodiment of the present invention.

FIG. 4 shows attack-resistant barrier 100, including flange 102; fastener 104; opaque portion 106; and attack-resistant windows 108. The flange and fasteners show an alternative, although not necessarily preferred, structure for attaching an attack-resistant device to the top of a barrier, such as a Jersey barrier. Preferably, the opaque portion is ballistic resistant and/or blast resistant. In fact, the use of opaque materials may result in a higher degree of ballistic resistance and blast resistance due to the decreased use and surface areas of substantially transparent attack-resistant material.

Figure 5:
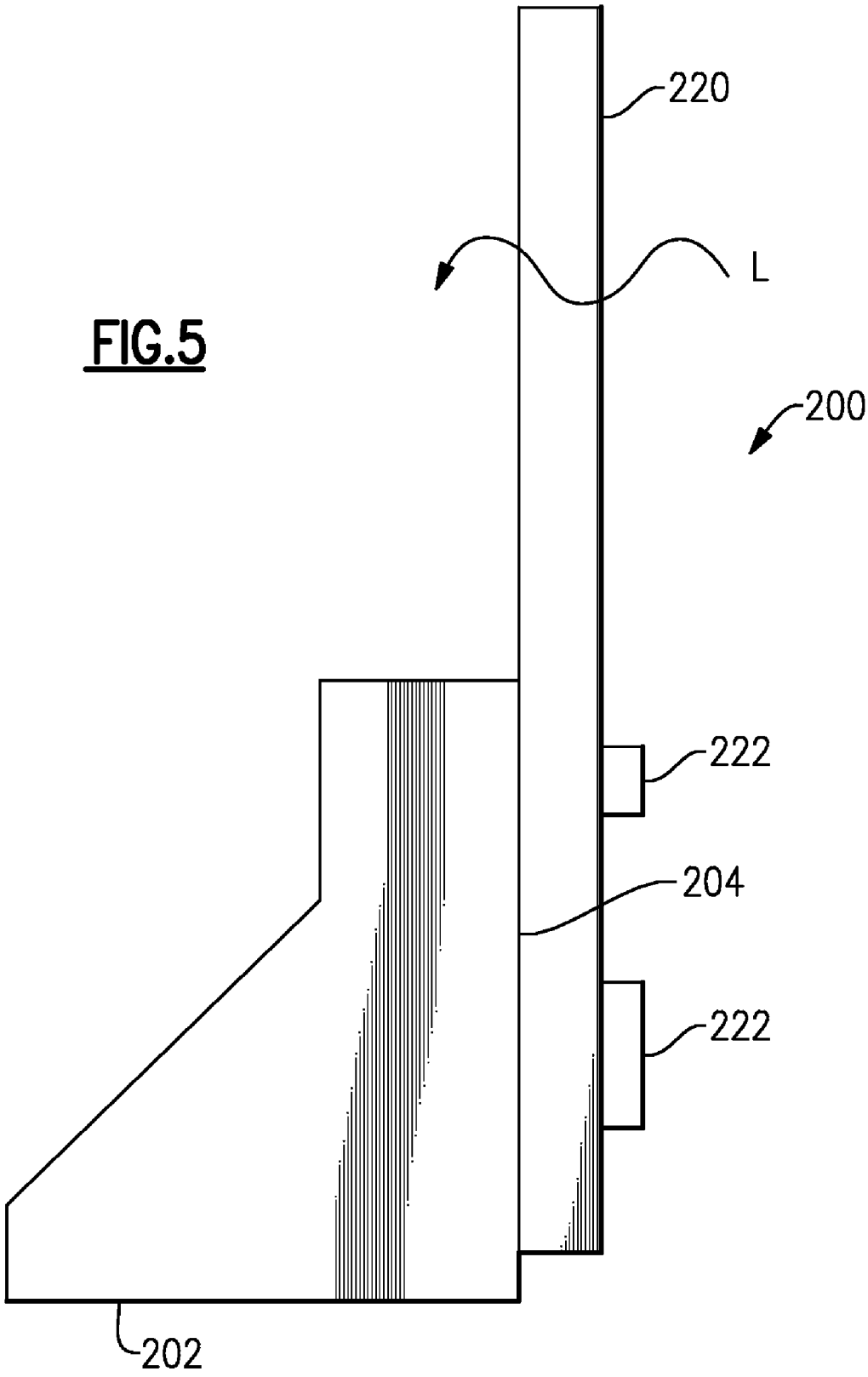
FIG. 5 is a side view of a barrier according to a third embodiment of the present invention.

FIG. 5 shows attack-resistant barrier 200, including concrete portion 202; end post 220; and fasteners 222. Although not shown, a front view of barrier 200 would look much like components 17, 20 and 21 of barrier 10, except that these components extend over flat surface 204 of concrete portion 202. As shown in FIG. 5, the concrete portion has been modified from the standard Jersey barrier shape to provide a flat mounting surface for the attack resistant device. Instead of fitting over the barrier portion as a cap, the attack resistant device is mounted to a major surface of the barrier by fasteners 222, potentially providing additional strength in the connection between the barrier portion and the attack-resistant device portion. The use of armor panels (not shown but similar to panels 17) allows light to pass thru the attack-resistant barrier in the direction of arrow L so that people protected by the barrier can see through it to the unprotected side.

DEFINITIONS

The following definitions are provided to facilitate claim interpretation:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Attach-resistant pane: Any substantially transparent window that is at least substantially resistant to ballistic and/or blast type forces; attack-resistant panes include, but are not limited to bullet-proof windows, bullet-proof shields and vehicles with bullet-proof windshields; attack-resistant panes may be made of any attack-resistant pane material now know or to be developed in the future.

Barrier: any device having suitable mass and/or anchoring and a shape such that it cannot be moved by a reasonable strong individual person; barriers include, but are not limited to: concrete barriers, Jersey barriers, Earth filled barriers, liquid filled barriers, barriers with outer walls of canvas, sand-packed barriers, gravel-filled barriers, plastic walled barriers, gel filled barriers and/or barrier designs to be developed in the future.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, force fit connections, friction fit connections, connections secured by engagement added by gravitational forces, quick-release connections, pivoting or rotatable connections, slidable mechanical connections and/or magnetic connections.

Vehicle barrier: any device having suitable mass and/or anchoring and a shape such that it is capable of at least substantially impeding the motion typical automobile across the barrier by physical interference between the typical automobile and the barrier; many barriers can stop even larger vehicles, but this is not necessarily required.

Unanchored Barrier: any barrier that is not anchored to the ground and/or a man-made structure.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. An attack-resistant barrier comprising:

a barrier member shaped as a Jersey barrier including a relatively narrow cap engaging portion and a relatively wide lower portion;

a cap comprising:

a barrier engaging portion shaped and located to wrap around the cap engaging portion, and a trough; and an upper wall defining an attack side major surface and a protected side major surface, the upper wall comprising:

a lower edge region mechanically connected to the trough, at least one attack-resistant pane having a plurality of pane edges, a plurality of channel members shaped and located to wrap around at least some of the pane edges of the plurality of pane edges, and a plurality of armor strips shaped and located on at least the attack side major surface as a facing over at least a portion of the channel members.

2. The barrier of claim 1 comprising a plurality of attack-resistant panes.

3. The barrier of claim 1 wherein the height of the barrier is at least six feet.

4. The barrier of claim 1 wherein the attack-resistant pane comprises glass.

5. The barrier of claim 4 wherein the attack-resistant pane comprises polycarbonate reinforcement.

6. The barrier of claim 1 wherein the attack-resistant pane comprises acrylic.

7. The barrier of claim 4 wherein the attack-resistant pane comprises polycarbonate reinforcement.

8. The barrier of claim 1 wherein the at least one attack-resistant pane has an Underwriter's Laboratories ballistic resistance rating of at least Threat Level One.

9. The barrier of claim 1 wherein the at least one attack-resistant pane has a National Institute of Justice ballistic resistance rating of at least NIJ-I.

10. The barrier of claim 1 wherein the at least one attack-resistant pane has a GSA Testing Standard blast resistance rating of at least level 2.

11. The barrier of claim 1 wherein the barrier member is shaped and adapted to be a vehicle barrier.

12. An attack-resistant barrier comprising:

a barrier engaging portion comprising a top surface, an opposed bottom surface and a first recess, the first recess extending into the barrier engaging portion from the bottom surface toward the top surface and having a first inner supporting surface, the barrier engaging portion configured to slidably engage a barrier member such that the first inner supporting surface abuts a portion of the barrier member; and a trough comprising an upper surface, an opposed lower surface and a second recess, the second recess extending into the trough from the upper surface toward the lower surface and having a second inner supporting surface, the trough being coupled to the barrier engaging portion and positioned such that the second inner supporting surface is located below the first inner supporting surface; and an attack-resistant wall mechanically connected to the barrier, the attack-resistant wall comprising:

at least one attack-resistant pane configured to slidably engage the trough and abut the second inner supporting surface, the attack-resistant pane including at least one substantially transparent portion; and a plurality of channel members configured to secure the at least one attack-resistant pane within the trough.

13. The barrier of claim 12 wherein the attack resistant upper wall further comprises an opaque portion that is attack-resistant.

14. The barrier of claim 12 wherein the at least one attack-resistant pane has a National Institute of Justice ballistic resistance rating of at least NIJ-I.

15. The barrier of claim 12 wherein the at least one attack-resistant pane has a GSA Testing Standard blast resistance rating of at least level 2.

16. The barrier of claim 12, further comprising the barrier member, wherein the barrier member is shaped and adapted to be a vehicle barrier.

17. An attack-resistant cap comprising:

a barrier engaging portion configured to attach the cap to a barrier member;

an attack-resistant wall connected to the barrier engaging portion, the attack-resistant wall defining an attack side major surface and a protected side major surface, the attack-resistant wall comprising:

at least one attack-resistant pane having a plurality of pane edges, a plurality of channel members shaped and located to wrap around at least some of the pane edges of the plurality of pane edges, and a plurality of armor strips shaped and located on at least the attack side major surface as a facing over at least a portion of the channel members.

18. The barrier of claim 17 wherein:

the at least one attack-resistant pane has an Underwriter's Laboratories ballistic resistance rating of at least Threat Level One; and the plurality of armor strips have an Underwriter's Laboratories ballistic resistance rating of at least Threat Level One.

19. The barrier of claim 17 wherein:

the at least one attack-resistant pane has an National Institute of Justice ballistic resistance rating of at least NIJ-I; and the plurality of armor strips have a National Institute of Justice ballistic resistance rating of at least NIJ-I.

20. The barrier of claim 17 wherein:

the at least one attack-resistant pane has a GSA Testing Standard blast resistance rating of at least level 2; and the plurality of armor strips have a GSA Testing Standard blast resistance rating of at least level 2.

21. An attack-resistant barrier comprising:

a barrier engaging portion comprising a top surface, an opposed bottom surface and a first recess, the first recess extending into the barrier engaging portion from the bottom surface toward the top surface and having a first inner supporting surface, the barrier engaging portion configured to slidably engage a barrier member such that the first inner supporting surface abuts a portion of the barrier member; and a trough comprising an upper surface, an opposed lower surface and a second recess, the second recess extending into the trough from the upper surface toward the lower surface and terminating at a second inner supporting surface, the trough being attached to the barrier engaging portion and positioned such that the second inner supporting surface is located below the first inner supporting surface; and an upper wall defining an attack side major surface and a protected side major surface, the upper wall comprising:

at least one attack-resistant pane having a plurality of pane edges, the at least one attack-resistant pane configured to slidably engage the trough such that one of the pane edges abuts the second inner supporting surface, the attack-resistant pane including at least one substantially transparent portion;

a plurality of channel members shaped and located to wrap around at least one of the pane edges of the plurality of pane edges, and a plurality of armor strips shaped and located on at least the attack side major surface as a facing over at least a portion of the channel members.

22. The attack-resistant barrier of claim 21, wherein the at least one attack-resistant pane comprises glass, polycarbonate reinforcement, or acrylic.

23. The attack-resistant barrier of claim 21, wherein the at least one attack-resistant pane has at least one of: an Underwriter's Laboratories ballistic resistance rating of at least Threat Level One; a National Institute of Justice ballistic resistance rating of at least NIJ-I; or a GSA Testing Standard blast resistance rating of at least level 2.

* * * * *